United States Patent [19]

O'Connor

[11] 4,168,546

[45] Sep. 25, 1979

[54] MANUFACTURE OF GARMENTS

[76] Inventor: Francis O'Connor, 2 Usher St., Dublin 8, Ireland

[21] Appl. No.: 808,609

[22] Filed: Jun. 21, 1977

[51] Int. Cl.[2] ..... A41F 9/00

[52] U.S. Cl. ..... 2/220; 2/236

[58] Field of Search ..... 2/236, 220, 237, 221, 2/76

[56] References Cited

U.S. PATENT DOCUMENTS

| | | | |
|---|---|---|---|
| 875,354 | 12/1907 | Kaplan | 2/236 |
| 1,762,283 | 6/1930 | Thomas et al. | 2/236 |

FOREIGN PATENT DOCUMENTS

| | | | |
|---|---|---|---|
| 206542 | 1/1956 | Australia | 2/236 |
| 210560 | 3/1956 | Australia | 2/236 |
| 210561 | 3/1956 | Australia | 2/236 |
| 213901 | 11/1957 | Australia | 2/236 |
| 668297 | 3/1952 | United Kingdom | 2/237 |

*Primary Examiner*—H. Hampton Hunter

*Attorney, Agent, or Firm*—Joel Halpern

[57] ABSTRACT

A material for use in forming garment waistbands, is constituted by an assembly of strips comprising a central strip serving for anti-slip, decorative or stiffening purposes and two facing strips stitched along respective marginal portions of the central strip. A method for making the material in a continuous operation is also disclosed.

4 Claims, 5 Drawing Figures

MANUFACTURE OF GARMENTS

BACKGROUND AND SUMMARY OF THE INVENTION

This invention relates to a material for use in making garment waistbands.

In the manufacture of garments, when forming a waistband, it is common practice to secure a length of material to the inside of the portion of the garment which will constitute the waistband. Such material may be employed for various purposes, such as to impart stiffness to the garment in the region of the waistband, or for purely decorative purposes, for example.

In some circumstances it may be desirable to apply to the inside of the waistband portion of a garment, material of such a nature as will counteract the tendency for one garment to slip relatively to another in the region of the waist of the wearer, during wear. The provision of such a waistband is particularly desirable in the case of trousers for example.

The invention is particularly applicable to a material for use in forming such an anti-slip waistband, but it is not limited to this application, and the invention can be applied to waistband material for other uses, such as for stiffening, or for decorative purposes, as referred to above.

It is known to construct an anti-slip waistband using ribbon-like material which has a frictional surface provided thereon. One form of such material consists of a strip of woven fabric having rubber threads woven into the fabric in such a way as to provide one or more narrow frictional zones or lines extending lengthwise of the strip. When two or more such frictional zones are provided, they extend parallel to one another and spaced apart somewhat, relatively to the width of the strip. In order to form the waistband of a garment such as trousers, a strip of such material has edging strips secured thereto, by means of lines of stitching, which are exposed to wear. During use of the garment, these lines of stitching quickly wear through and the waistband of the garment then disintegrates.

It is therefore one object of the present invention, to provide an improved material for use for forming garment waistbands.

It is another object of the invention, to provide a composite waistband material which will be durable in use.

It is a further object of the invention, to provide a composite waistband material which can readily be manufactured from its component strips in a continuous operation.

It is a still further object of the invention to provide a method of making a material for forming garment waistbands, which will enable material to be readily manufactured in an economical manner.

In the improved waistband material provided by this invention, two strips of facing material are employed in conjunction with a frictional, decorative or other strip (referred to hereinafter for convenience as "a central strip"), each facing strip comprising a length of fabric extending along one edge of the central strip, so that the two edge portions of the central strip are covered, while leaving exposed the intermediate region of the depth of the face of the central strip which may be provided with frictional, decorative or other zones.

During the manufacture of the waistband material according to the invention, each facing or cover strip is secured along the corresponding edge of the central strip by stitching, but is folded back upon itself so that the line of stitching which secures the facing strip to the central strip is covered by the material of the facing strip itself. Thus the stitching is protected against wear.

The invention will be more clearly understood from the following detailed description of preferred embodiments thereof given, by way of example only, with reference to the accompanying drawings.

DESCRIPTION OF THE PREFERRED EMBODIMENTS OF THE INVENTION

Figure 1:
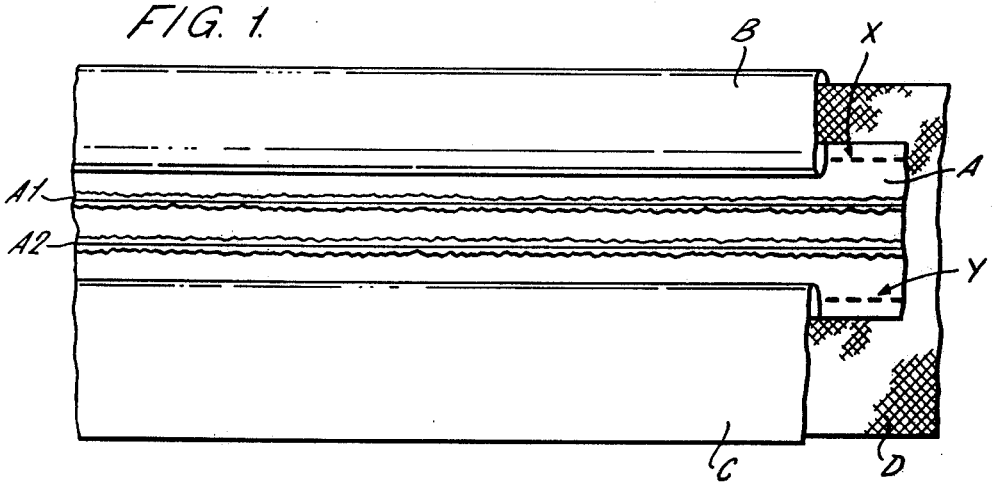
FIG. 1 shows the front face of one form of finished composite waistband material in accordance with the invention, broken away at one end to show the various layers thereof.
Figure 2:
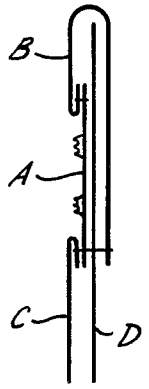
FIG. 2 is a diagrammatic sectional view through the material.
Figure 3:
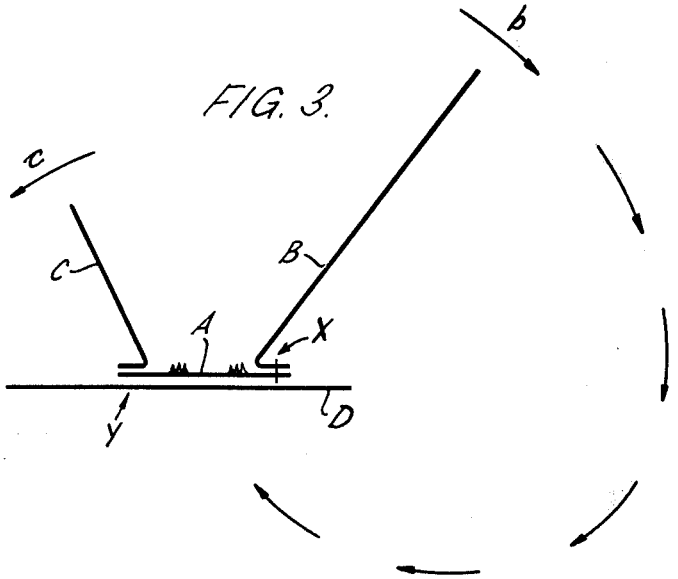
FIG. 3 is a corresponding diagrammatic sectional view, but showing an intermediate stage in the manufacture of the composite waistband material.

Referring to FIGS. 1 to 3 of the drawings, the waistband material of the invention comprises a frictional strip A, together with facing or cover strips B and C. The frictional strip A is of the form previously described and comprises woven rayon fabric with two frictional zones A1, A2 extending lengthwise thereof, formed by rubber threads woven or braided into the rayon fabric, so as to provide a frictional surface in the intermediate region of the face of the strip A which in use will be the front face. The strips B and C are of knitted nylon fabric.

In addition, the composite material incorporates a backing strip D which supports the strips A, B and C. The strip D is made of relatively stiff material, such as canvas or gauze, or a compressed felted material such as that known as Vilene.

The composite material is manufactured from its component strips in a continuous process involving the use of guides relative to which the individual strips are fed lengthwise. The guides are made of sheet metal bent into a convoluted cross-section so as to provide guide-members or surfaces which are adapted to guide the various strips into the correct relative dispositions.

The facing strip B and the central frictional strip A are fed in superposed relationship, with their edges in register and with the marginal portion of facing strip B overlying the corresponding marginal portion of frictional strip A. The strips A and B are fed, together with the backing strip D, past a sewing machine by means of which the facing strip B is secured to the frictional strip A by means of stitching, at position X. During forward feeding of the strips beyond the sewing machine, a suitable guide acts to fold the facing strip B over upon itself as indicated by the arrow b in FIG. 3 so that the material of the strip covers the stitching at X.

As the assembly of strips continues to be fed forwards beyond the sewing machine, the guide exerts a further guiding action so that the facing strip B is drawn around the edge of the backing strip D, as indicated by the succession of arrows in FIG. 3, until it reaches the position in which a portion of the strip B extends behind the central strip A and the backing strip D, with the folded portion of the strip B coming into contact with the rear surface of the backing strip D.

Facing strip C is now fed in the desired disposition relative to the other strips, with the marginal portion of strip C overlying the corresponding marginal portion of strip A and the assembly of strips passes to a second sewing machine which, by a single stitching operation at position Y, secures together simultaneously, the free marginal portion of the facing strip B, the backing strip D, the frictional strip A and the marginal portion of the facing strip C. Finally, the strip C is folded over upon itself in the direction of the arrow c, by the action of a further guide, until it overlies the surface of the backing strip and covers the stitching at Y. As the completed waistband material emerges from the manufacturing process, it is subjected to a hot-pressing operation, so as to set the various components in their correct positions relatively to one another, and it is then made up into rolls.

It will be noted that, in the method described above, two separate sewing operations are required in order, firstly to stitch the facing strip B to the central strip A at position X, and then to stitch the facing strip C to the remaining strips (including the second margin portion of the strip B) at position Y. If, however, the second margin portion of the strip B were not to be secured to the other strips at Y, in the manner described, then it would be possible for the stitching of the two facing strips to the front of the central strip A (at X and Y) to be carried out simultaneously, in a single sewing operation. In either case, one or more guides are employed which, as the constituent strips are fed past them, serves or serve to fold the facing strips B and C back upon themselves so that the two margin portions of the front face of the central strip A are covered by the facing strips B and C, while leaving exposed the intermediate region of the said front face. The stitching which secures each facing strip B or C to the central strip A is covered by the folded-back facing strip, so that the said stitching is protected against wear.

Figure 4:
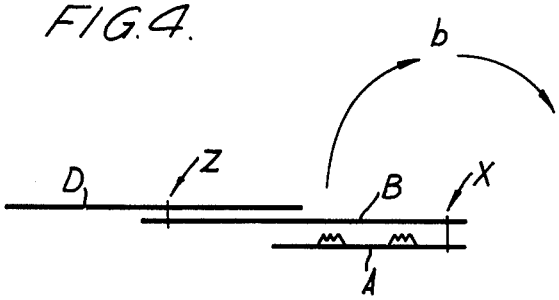
FIGS. 4 and 5 are diagrammatic sectional views illustrating the manufacture of a modified form of waistband material.
Figure 5:
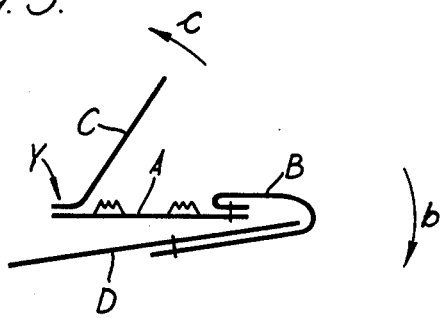

Referring now to FIGS. 4 and 5 of the drawings, there is illustrated a method for making a slightly modified form of waistband material. As in the embodiment previously described, the composite material comprises a central frictional strip A, facing strips B and C and a relatively stiff backing strip D. However, in this case, the strips are initially fed with the facing strip B overlying the front face of the strip A and with the backing strip D overlapping the edge portion of the strip B, as shown in FIG. 4. As the strips are fed in the relative dispositions shown in FIG. 4, two lines of stitching are formed simultaneously at positions X and Z, by means of a double-needle sewing machine. During forward feeding of the strips beyond the sewing machine, a suitable guide acts to fold the facing strip B over upon itself as indicated by the arrows b in FIGS. 4 and 5, thus carrying with it the backing strip D. The facing strip B and the backing strip D are thus drawn around the edge of the central strip A, into the position shown in FIG. 5.

Facing strip C is now fed in the desired disposition relative to the central strip A, with the marginal portion of strip C overlying the corresponding marginal portion of strip A, as shown in FIG. 5. The assembly of strips passes to a second sewing machine which stitches the marginal portion of strip C to the strip A at position Y. If desired the same stitching operation can simultaneously secure the strips A and C to the backing strip D, or alternatively the backing strip D can be left in the form of a loose flap, as shown in FIG. 5. Finally the strip C is folded over upon itself in the direction of the arrow c, by the action of a further guide, so that it covers the stitching at Y. The completed material is then hot-pressed and made up into rolls, as before.

It will be understood that when material as described above is used to form an anti-slip waistband on garments such as trousers for example, the lines of stitching by means of which the cover strips are secured to the frictional strip are completely covered by the said cover strips, as viewed from the front. Thus, there is no risk that the stitching will wear through and cause the waistband to disintegrate. Accordingly, the waistband material provided by the invention is extremely durable in use.

The particular forms of waistband material which have been described in detail herein, have been described by way of example only, and modifications may be made therein without departing from the scope of the invention. For instance, the frictional strip employed in the materials described above can be replaced by a central strip of fabric carrying a fancy decorative pattern, or by a strip serving merely for stiffening purposes, without altering the arrangement whereby the cover strips on either side of the central strip are arranged so as to protect against wear, the stitching by means of which the cover strips are secured to the central strip.

I claim:

1. A material for use in forming garment waistbands constituted by an assembly of strips, comprising a longitudinally extending central strip, two facing strips extending respectively along opposed longitudinal marginal portions of one face of said central strip, and a backing strip lying behind the other face of said central strip, each said facing strip being folded over upon itself so as to have a first portion in overlying contact with the corresponding said marginal portion of said central strip and a folded-over second portion overlying said first portion, said second portions of said respective facing strips extending outwardly away from one another so as to define therebetween an exposed intermediate region of said one face of said central strip, a first longitudinal line of stitching being provided securing the first portion of one of said facing strips to the underlying portion of said central strip, said backing strip positioned to undrlie the other face of said central strip having a width at least as great as that of said central strip, said one facing strip having a further fold defining a third portion thereof extending around the underlying edges of said central and backing strips and behind said backing strip at least a sufficient distance transversely so as to underlie the backing strip at the location where the first portion of the other facing strip is in overlying contact with the other marginal portion of said central strip, a second longitudinal line of stitching being provided extending through said third portion of said one facing strip, through said backing strip, through said central strip and through said first portion of said other facing strip to simultaneously secure all of said strips together, said first and second lines of stitching being covered by said second portions of said facing strips to be thereby protected when in use, against wear.

2. A material according to claim 1, wherein said exposed intermediate region of said one face of said central strip has a frictional surface.

3. A method of making a material for use in forming garment waistbands constituted by an assembly of strips including a longitudinally extending central strip, two strips of facing material extending respectively along opposed longitudinal marginal portions of one face of said central strip, and a backing strip lying behind the other face of said central strip, said method comprising:

(a) providing a central strip and a first strip of facing material in superposed relation to the corresponding lengthwise marginal portion of one face of said central strip together with a backing strip underlying the opposite face of said central strip;

(b) stitching the marginal portion of said first facing strip to said corresponding marginal portion of said central strip such that said marginal portion of said first facing strip extends along the corresponding marginal portion of said central strip on said one face thereof;

(c) folding said first facing strip over upon itself so as to define a second portion thereof overlying its said marginal portion to thereby leave exposed an intermediate region of said one face of said central strip and to also cover the stitching which secures said marginal portion of said first facing strip to said central strip by said folded-over second portion of said first facing strip to protect said stitching against wear;

(d) further folding said first facing strip such that a third portion thereof is folded about the underlying edges of said central and backing strips to extend behind the central strip with the backing strip interposed therebetween;

(e) providing a second strip of facing material in superposed relation to the opposed lengthwise marginal portion of said one face of the central strip;

(f) simultaneously stitching the free marginal portion of said first facing strip, said backing strip, said central strip and the marginal portion of said second facing strip;

(g) folding said second facing strip over upon itself until it overlies the surface of the backing strip and covers the stitching securing same to the underlying central strip, backing strip and first facing strip;

and (h) setting said facing strips in their said folded-over positions relative to said central strip.

4. A method according to claim 3, which includes the additional steps of thereafter pressing said assembly of strips in a continuous operation and forming said assembly into a roll.

* * * * *